US006179416B1

(12) United States Patent
Ikeda et al.

(10) Patent No.: US 6,179,416 B1
(45) **Date of Patent: *Jan. 30, 2001**

(54) EXCHANGEABLE INK CARTRIDGE

(75) Inventors: Masami Ikeda, Yokohama; Sadayuki Sugama, Tsukuba; Tsutomu Abe, Isehara; Toshio Kashino, Chigasaki; Masahiko Higuma, Tohgane; Takeshi Okazaki, Sagamihara; Hiroki Tajima, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/959,706

(22) Filed: Oct. 27, 1997

Related U.S. Application Data

(63) Continuation of application No. 08/293,321, filed on Aug. 19, 1994, now abandoned.

(30) Foreign Application Priority Data

Aug. 23, 1993 (JP) ..... 5-207712
Aug. 23, 1993 (JP) ..... 5-207714

(51) Int. Cl.[7] ..... B41J 2/175
(52) U.S. Cl. ..... 347/86
(58) Field of Search ..... 347/85–87

(56) References Cited

U.S. PATENT DOCUMENTS 4,831,389 * 5/1989 Chan ..... 347/86
4,968,998 11/1990 Allen .
5,051,759 9/1991 Karita et al. .
5,119,115 6/1992 Buat et al. .
5,155,502 10/1992 Kimura et al. .
5,187,498 * 2/1993 Burger ..... 347/86
5,509,140 * 4/1996 Koitabashi et al. ..... 347/87
5,552,816 * 9/1996 Oda et al. ..... 347/86

FOREIGN PATENT DOCUMENTS

G0084913 3/1987 (DE) ..... B41J/27/00
488829A2 * 6/1992 (EP) ..... 347/87
529625 3/1993 (EP) .
536980 4/1993 (EP) .
546544 6/1993 (EP) .
0580433 1/1994 (EP) ..... B41J/2/175
64-35215 * 6/1986 (JP) .
640043 * 2/1994 (JP) ..... 347/85

* cited by examiner

*Primary Examiner*—N. Le
*Assistant Examiner*—Judy Nguyen
(74) *Attorney, Agent, or Firm*—Fitzpatrick, Cella, Harper & Scinto

(57) ABSTRACT

An ink cartridge includes a negative pressure producing material; an accommodating portion for accommodating the negative pressure producing material, the accommodating portion is provided with an opening for receiving an ink supply tube of an ink jet recording head; wherein the material is sandwiched between surfaces in the accommodating portion, and a distance between the surfaces smaller than twice an outer diameter of the ink supply tube.

5 Claims, 13 Drawing Sheets

EXCHANGEABLE INK CARTRIDGE

This application is a continuation of application Ser. No. 08/293,321 filed Aug. 19, 1994 now abandoned.

FIELD OF THE INVENTION AND RELATED ART

The present invention relates to an ink cartridge, detachably mountable to an ink jet recording head, for containing ink to be ejected through a recording head.

An ink jet recording system is known to effect recording on a recording material such as paper, OHP sheet. The ink jet recording system is such that the ink is ejected to the recording material from a recording head, and therefore, the running cost is low and the noise produced is low.

Recently, a type of ink jet recording system in which a recording head and an ink container are carried on a carriage and are scanningly moved, is particularly noted from the standpoint of downsizing of the apparatus.

Furthermore, in consideration of the fact that the service life of the recording head is longer than the service life of the ink container, the ink container is made separable from the recording head.

Referring to FIG. 1, such an exchangeable ink container is illustrated.

An outer wall of an ink container 21 is provided with an ink supply port 23 for permitting supply of the ink to the recording head 22. By connecting an ink supply pipe 24 of a recording head 22 to the ink supply port 23, the supply of the ink is permitted from the ink container to the recording head 22.

Designated by a reference numeral 27 is an air vent to function to introduce the air into the ink container upon ink supply. The ink container 21, an ink retaining member 25 is provided. By the proper ink retaining force of the retaining member 25, the ink is prevented from leaking through the recording head 22, and proper ink supply to the recording head 22 is assured. As for the ink retaining member 15, cotton like fibers or porous materials having continuous pores, are usable. Particularly, sponge material of polyurethane foam or the like is widely used because the ink retaining force can be easily adjusted.

In an ink jet cartridge having an integral recording head and ink container, an ink supply pipe of the recording head is fixedly mounted relative to the ink retaining member or a vacuum generating member in the ink container under a predetermined pressure of contact. By doing so, the vacuum producing member is maintained at a predetermined compressed state so that the air introduction at the contact portion is prevented. In addition, the vacuum producing material is compressed to increase the capillary force toward the supply pipe, and therefore, the adjacent ink can be concentrated to the supply pipe. The situation is different in an ink cartridge which is detachably mountable to the recording head. That is, the mounting can be easy for the operator, and after the mounting, the ink supply performance is to be reliable. In addition, even if the mounting actions by the user is repeated, the ink supply reliability is to be maintained.

On the other hand, the demand for the downsizing of the recording apparatus, the width W, the height H and the depth D of the ink container are desired to be as small as possible. However, this reduces the usable quantity of the ink contained therein with the result of frequent exchange of the ink container, and in addition, a high running cost.

In the case of color recording, ink containers of various colors such as yellow, magenta, cyan and black colors, are disposed in parallel. In this case, the most desirable is the reduction of the width W. Therefore, it would be considered to increase the ink capacity by increasing the height H or the depth D because the reduction of the ink capacity is not desired. However, if the width W is small and the height H is large, it is difficult to insert the vacuum producing material into the container during the manufacturing of the ink container. In addition, if the height H is large, the vacuum producing property is different between when the ink container is full-(high static head) and when a substantial quantity of the ink has been consumed. Thus, the ink ejection property of the recording head is influenced. In other words, the print qualities are not stable. When the depth D is increased to increase the ink capacity, the distance through which the ink moves through the vacuum producing material to the recording head is significantly different between when the ink container is full and when a substantial quantity of the ink has been consumed. This also is a cause of deterioration of the print quality.

SUMMARY OF THE INVENTION

Accordingly, it is a principal object of the present invention to provide an ink cartridge with which the ink supply to the recording head is stably assured.

It is another object of the present invention to provide an ink cartridge with which a reliable connection with an ink supply tube of a recording head is assured.

According to an aspect of the present invention, there is provided an ink cartridge comprising: a negative pressure producing material; an accommodating portion for accommodating the negative pressure producing material, the accommodating portion is provided with an opening for receiving an ink supply tube of an ink jet recording head; wherein the material is sandwiched between surfaces in the accommodating portion, and a distance between the surfaces smaller than twice an outer diameter of the ink supply tube.

According to a further aspect of the present invention, there is provided an ink cartridge comprising: a negative pressure producing material; an accommodating portion for accommodating the negative pressure producing member, the accommodating portion being provided with an opening for receiving an ink supply tube of a recording head; wherein a width W of a side having the opening, a height H and a depth D satisfy $$W \leqq H \leqq 4W, \text{ and}$$

$$W \leqq D \leqq 10W,$$

wherein the ink cartridge is generally rectangular parallelepiped.

According to a further aspect of the present invention, there is provided a plurality of the ink cartridges are juxtaposed into a unified ink cartridge, and for each of ink cartridges, $$W \leqq P \leqq H$$

where P is an interval between adjacent ink jet recording head in its moving direction.

According to a further aspect of the present invention, there is provided an ink cartridge comprising: a negative pressure producing material; an accommodating portion for accommodating the negative pressure producing material, the accommodating portion being provided with an opening for receiving an ink supply tube of an ink jet recording head; where a width W of a side having the opening, H height, a depth D and a diameter of the ink supply tube satisfy:

$$W \leqq H \leqq 4W,$$

$$W \leqq D \leqq 10W,$$

$$W/2 \leqq N,$$

wherein the ink cartridge is generally rectangular parallelepiped.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail. (Embodiment 1)

Figure 1:
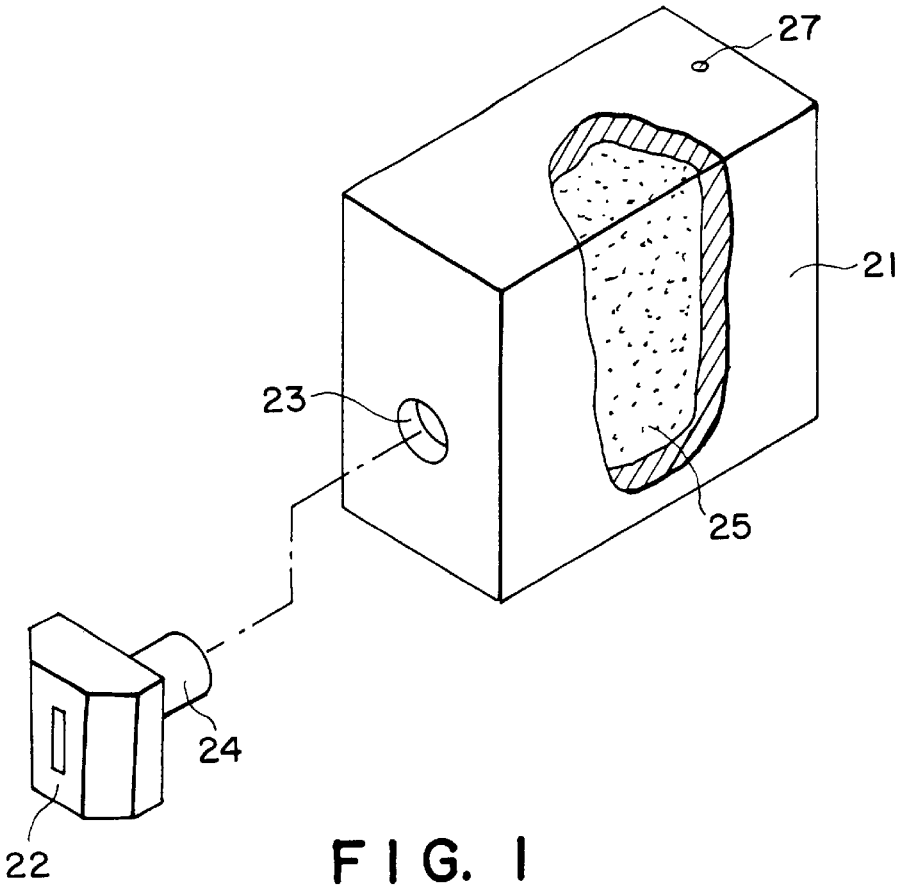
FIG. 1 PRIOR ART
FIG. 1 is a perspective view of a conventional example of an ink cartridge.
Figure 2:
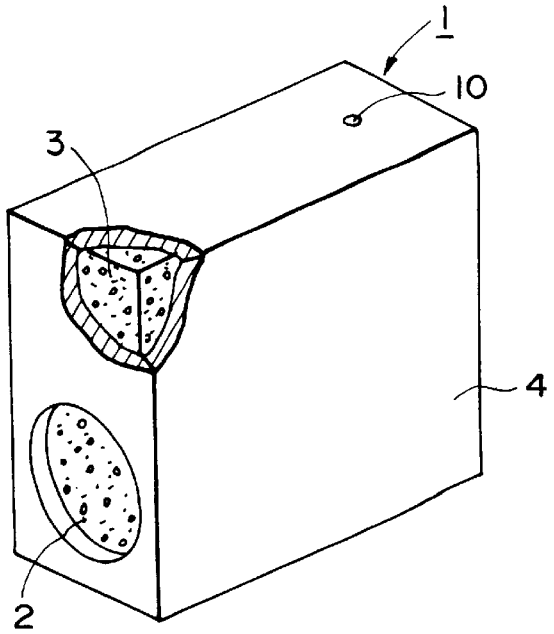
FIG. 2 is a perspective view of an ink cartridge according to an embodiment of the present invention.

FIG. 2 is a perspective view of an ink cartridge according to an embodiment of the present invention, in which a corner is cut away.

As shown in this Figure, the main body 1 of the ink cartridge according to this embodiment is provided with an opening 2 for permitting connection with an ink jet recording head, and is further provided with a vacuum producing material accommodating portion 4 for accommodating a vacuum producing material 3. The material 3 is filled with the ink.

At the opposite side from the opening, the accommodating portion 4 is provided with an air vent 10 for introducing the air thereinto.

Figure 3A:
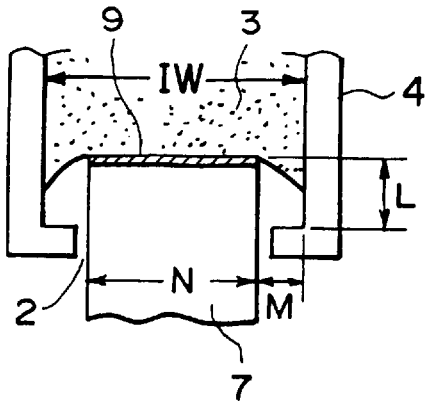
FIGS. 3A, 3B and 3C are sectional views of the ink container.

FIG. 3A shows a state in which a joint member 7 for supplying the ink to the ink jet recording head is inserted into the exchangeable ink cartridge, and is press-contacted to the vacuum producing material 3, so that the ink jet recording apparatus is operable. At an end of the joint member, there is provided a filter 9 for removing foreign matters in the ink cartridge.

When the ink jet recording apparatus is operated, the ink is ejected through orifices of the recording head, by which ink absorbing pressure is produced in the exchangeable cartridge. The ink contained in the vacuum producing material is introduced into the joint member (ink supply pipe) 7 by the absorbing pressure or force, so that the ink is supplied to the ink jet recording head. The accommodating portion 4 is provided with the air vent 10, and therefore, the air is introduced through the air vent 10 into the vacuum producing material 3 when the ink is supplied out to the recording head through the joint member 7, thus balancing the pressure in the vacuum producing material.

During non-recording, the capillary force of the vacuum producing material 3 is used to prevent leakage of the ink through the ink jet recording head.

As shown in FIG. 3A, when the joint member 7 of the recording head is inserted, the vacuum producing material 3 of the exchangeable ink cartridge is compressed, so that the compression of the vacuum producing material 3 is increased adjacent the filter 9. A wall of the accommodating portion 4 is provided adjacent the joint member 7, and therefore, upon the compression of the vacuum producing material 3 by the insertion of the joint member, the vacuum producing material 3 is sandwiched by the walls of the accommodating portion 4, thus preventing deformation of the entirety of the material. Therefore, only the portion of the filter 9 adjacent the filter is efficiently compressed.

Because the compression is efficient adjacent the filter 9, the meniscus force of the vacuum producing material is increased in the adjacent portion, by which the introduction of the air through the compressed vacuum producing material can be prevented. In addition, the leakage of the ink is prevented, while permitting smooth supply of the ink to the recording head through the joint member 7.

Figure 3B:
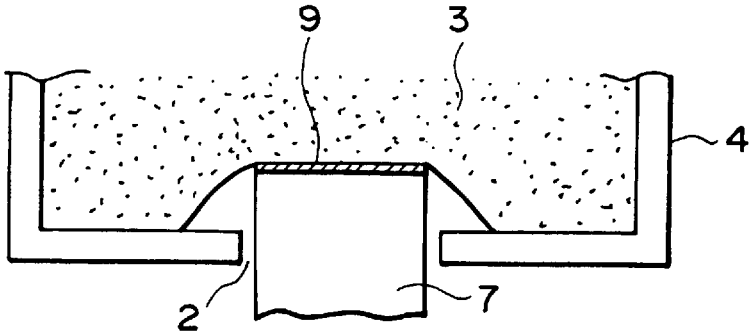
Figure 3C:
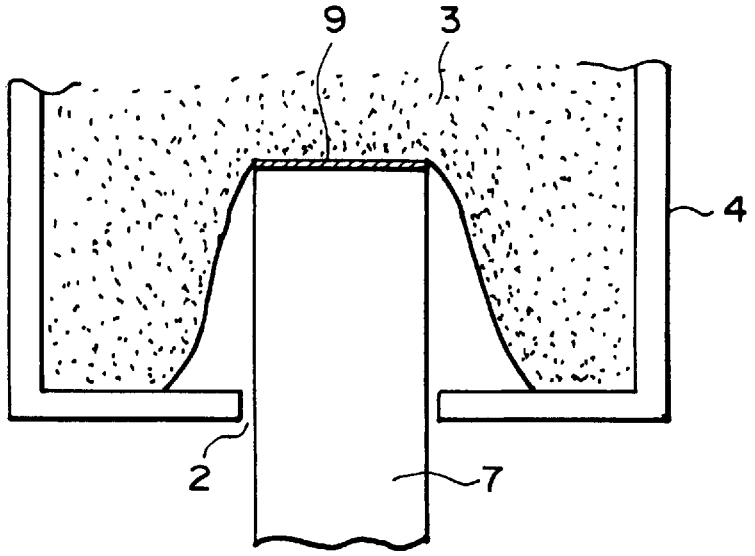

When the walls of the accommodating member for accommodating the vacuum producing material are substantially away from the opening 2 for receiving the joint member 7 as shown in FIG. 3B, the sufficient compression is not provided even if the degree of insertion is the same as in FIG. 3A. Therefore, the ink supply is riot proper, or the ink may leak.

In order to provide the same effects as in FIG. 3A, it would be considered to increase the degree of insertion of the joint member 7, thus providing the equivalent compression. However, if this is done, the amount of deformation of the vacuum producing material 3 is so large that the ink contained in the vacuum producing material 3 is discharged with the possible result of ink leakage at the opening 2.

In the case of the exchangeable cartridge, there is a possibility that the cartridge is mounted and demounted repeatedly. If the compression and release of the vacuum producing material 3 is repeated adjacent the opening 2, the air may enter this part. Then, the ink supply may be stopped when it is remounted.

Therefore, it is desirable that the vacuum producing material 3 is not easily moved, by moving the walls toward the opening 2 for receiving the joint member 7.

As a result of various investigations and experiments, the following has been found. First, the degree of insertion L of the joint member will be considered. The diameter N of the joint member 7 is 6 mm. In this case, it has been confirmed that the degree of insertion L is preferably approx. 6 mm in order to avoid the air introduction upon the repeated mounting and demounting actions and in order to avoid introduction of the air. When the joint member 7 is inserted, the cell size of the vacuum producing material is 35–40/cm, and the compression (ratio) is 3–4 (times).

If the degree of insertion relative to the joint member diameter N is larger than that, the quantity of the ink discharged by the insertion of the joint member 7 (degree of insertion Lxtube area S), is large with the result of ink leakage from the opening 2. If the insertion degree L is smaller than that, the desired compression is not provided. Preferably, it is not less than approx. 4 mm.

In consideration of the discharge of the ink by the joint member 7 inserted, it is preferable that there is a space capable of retaining the ink adjacent the opening.

It is desirable that upon the insertion of the joint member 7, the vacuum generating material in the form of a sponge slightly moves along the wall surfaces sandwiching the sponge. The space provided by the movement is able to retained the discharged ink. In order to permit such movement relative to the wall surfaces, the distance M between the wall surface and the surface of the joint member is preferably approx. 3 mm.

From the foregoing, the distance between the walls is preferably approx. 12 mm when the diameter of the joint member N is 6 mm. From this, it is desirable that the diameter N and the distance IW preferably satisfies $IW/2<N$. In addition, the diameter N and the degree of insertion L preferably satisfies that N nearly equals to L.

The distance IW is a limitation to a size of the container. From the standpoint of the larger ink capacity, the height H and the depth D are limited from the standpoint which will be described hereinafter, and therefore, the rectangular shape shown in FIG. 2 results. In order to provide better utilization factor of the ink, the opening is located as low position as possible. The sponge compression for providing the above-described effects, the opposite side walls are used.

In order to use the exchangeable ink cartridge in a color ink jet apparatus, the black ink, yellow ink, magenta ink and cyan ink may be contained in separate exchangeable ink cartridges. The respective ink cartridge may be unified into an exchangeable ink cartridge. Or, the most frequently used black ink cartridge, may be separate from the other ink cartridges, and the non-black ink cartridges may be unified. Any desirable conditions are possible.

In an exchangeable ink cartridge, in order to control the vacuum in the ink jet recording head, the selection of the material, configuration and dimensions of the vacuum producing material is to be considered. In addition, the inside surfaces of the vacuum generating material accommodating portion may be provided with ribs to permit smooth exchange between the ink and the air. The dimensions of the vacuum producing material accommodating portion, the quantity of injected ink, the configuration, dimension and mesh of the filter, and the surface tension of the ink are preferably optimized.

The vacuum producing material usable in this embodiment may be any known material if it is capable of retaining the ink even upon vibration thereof. The examples include a porous material having continuous pores or a sponge like material of fibers. A sponge of polyurethane foam is preferable since the ink retaining power and the vacuum production are easily adjustable. Particularly, in the case of the foamed material, the density can be adjustable during manufacturing, and therefore, it is desirable. When the foam material is thermo-compressed to further adjust the density, decomposition material may be produced by heat with the result of influence to the ink property, an therefore, the print quality. Therefore, cleaning or the like will be required. The density of the foamed material are determined for the respective exchangeable ink cartridge. A large foamed material having a predetermined cell numbers (number of cells per 1 inch) not subjected to the thermal compression, may be cut into desired dimensions. When this is inserted into the vacuum producing material accommodating portion with compression, so that the density and the capillary force are adjusted.

In the foregoing, a clearance is provided between the joint member 7 and the opening 2 therefor, so as to permit introduction of the air. However, this structure is not limited, and the joint member and the opening may be properly determined by one skilled in the art in the structure and the configuration. In the case of the porous material such as sponge used as the vacuum producing material, the end of the joint member 7 is preferably tapered relative to the joint member insertion direction for the purpose of controlling escape of the porous material at the bottom of the ink cartridge by the insertion of the joint member and for the purpose of maintaining the press-contact surface between the filter and the vacuum producing material. In order to provide the air venting opening, the outer surface of the joint member may be provided with a groove or grooves. Preferably, the clearance may be determined such that the joint member and the opening are not sealed. Or, at the bottom of the opening (bottom of the ink cartridge), the joint member is contacted to the bottom of the opening, but at the top, the clearance is formed.

As described, in the exchangeable ink cartridge of this embodiment, the joint opening also functions as a portion for introducing the air, and therefore, the structure is simple. The degree of insertion of the joint member 7 into the exchangeable ink cartridge, is determined in consideration of the prevention of the ink leakage upon the insertion and prevention of the ink stop during the recording, taking into account the configuration of the joint member, the vacuum producing material and the configuration of the ink cartridge. As desired, an air vent is provided in the vacuum generating material accommodating portion in addition to the joint opening. By doing so, the reliability against the ambient condition change in the ink jet recording apparatus can be further improved.

The configuration, dimensions and the mesh of the filter at the end of the joint member 7 may be property determined depending on the ink jet recording apparatus to be used therewith. It is preferable that the size thereof is slightly smaller than the orifice diameter to prevent clogging of the nozzle of the recording head with the foreign matter introduced from the ink cartridge.

As for the ink in the exchangeable ink cartridge, any known inks are usable. The quantity of the ink in the exchangeable ink cartridge may be determined with the limit of the volume of the ink cartridge. However, in order to maintain the vacuum immediately after the opening of the exchangeable ink cartridge, it is preferably less than the limit of ink retention of the vacuum producing material. Here, the ink retention or retaining power means the quantity which can be retained by the material itself.

The structure and the configuration of the exchangeable ink cartridge may be modified under the condition that the above-described diameter N, the distance IW and the insertion L are as described above.

Figure 4:
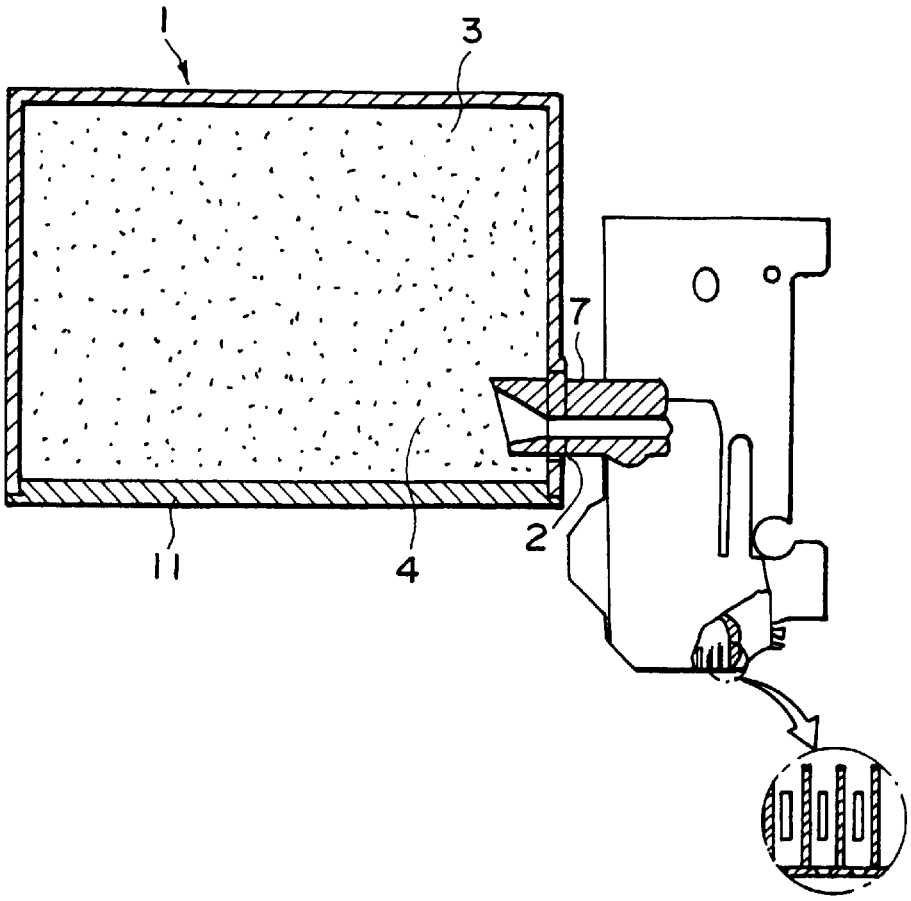
FIG. 4 illustrates an ink container mounted to a recording head.

FIG. 4 illustrates the ink container of this embodiment mounted to the recording head. The ink container comprises a bottom cover 11 in the foam of a flat plate. The container can be constructed in such a simple manner.

The joint member 7 of the recording head is inserted into the opening of the ink container, and the joint member 7 is tapered with which the top portion is forward than the bottom portion. The ink passage in the joint is horn-like opening upwardly. With this structure, the ink can be introduced into the head from the ink absorbing material.

(Embodiment 2)

In this embodiment, the diameter of the joint member N, the distance IW between walls and the degree L of the insertion described above are also satisfied in this embodiment.

In the case of the exchangeable ink cartridge, the high ink utilization factor is desirable because of the low running cost and of the environmental problem.

Figure 5:
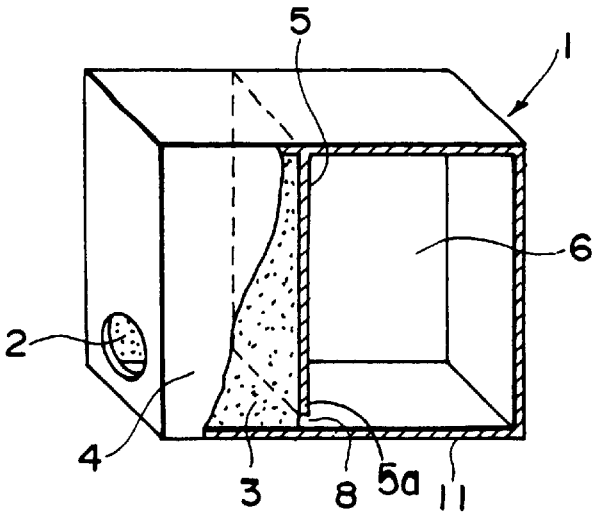
FIG. 5 is a perspective view of an ink cartridge according to another embodiment of the present invention.

FIG. 5 illustrates an ink cartridge of Embodiment 2 in which ink utilization factor is improved.

The body 1 of the ink cartridge is provided with an opening 2 for connection with the ink jet recording head, and is provided with a vacuum producing material accommodating portion 4 for accommodating a vacuum producing material 3, and an ink container 6 for containing ink and in fluid communication with the vacuum producing material accommodating portion 4 at a bottom 11 of the ink cartridge through a rib 5.

The description will be made as to the operational principle of the ink cartridge of this embodiment.

When the ink jet recording apparatus is operated, the ink is ejected through the orifices of the ink jet recording head, so that ink absorbing pressure is produced in the exchangeable ink cartridge. The ink is supplied into the ink jet recording head by the absorbing pressure through a clearance 8 between an end of the rib and the bottom 11 of the ink cartridge, the vacuum producing material accommodating portion 4, the vacuum producing material 3 and the joint member 7.

By this, the internal pressure of the ink container 6 which is sealed except for the clearance 8, reduces, thus producing pressure difference between the ink container 6 and the vacuum producing material accommodating portion 4. With the continuance of the recording operation, the pressure difference continues to increase. However, the vacuum producing material accommodating portion is open to the air by a clearance 10 between the joint member portion and the opening for the joint, so that the air is introduced into the ink container 4 through the gap 8 between the rib end 5*a* and the ink cartridge bottom 11 through the vacuum producing material accommodating portion 4. During the ink jet recording operation, the above is repeated so that a predetermined level of the negative pressure is maintained in the ink cartridge. Substantially all of the ink in the ink container can be used up except for the ink deposited on the inside surface of the ink container, and therefore, the ink utilization factor is improved.

When the recording operation is not carried out, the capillary force of the vacuum producing material itself (or the meniscus force between the ink and the vacuum producing material), is produced, so that the leakage of the ink from the ink jet recording head can be suppressed.

Because of the structure of the recording head and the structure of the carriage in the recording apparatus, the width IW with which the vacuum producing material is sandwiched, is not the same as that of the body of the ink cartridge.

Figure 8:
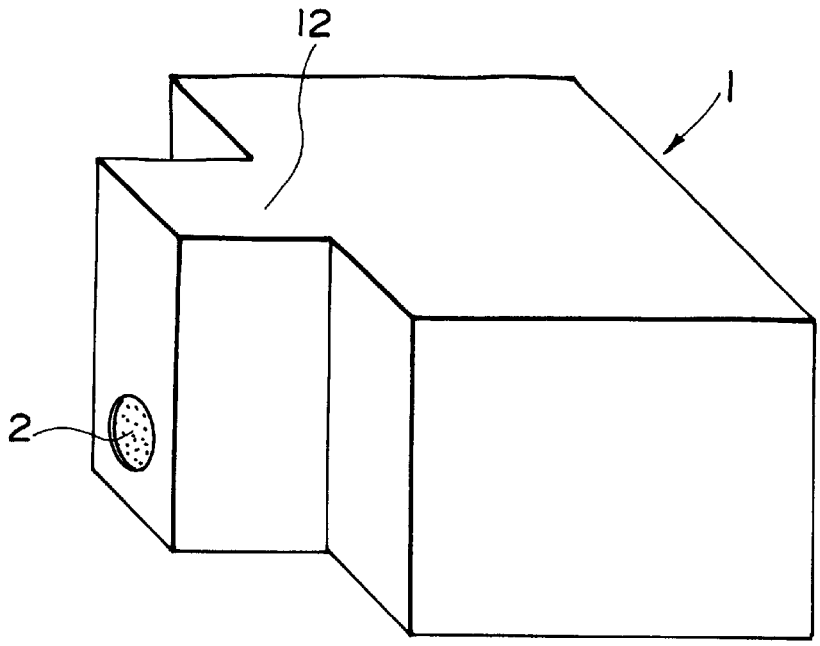
FIG. 8 is a perspective view of an ink cartridge according to a further embodiment of the present invention.
Figure 9:
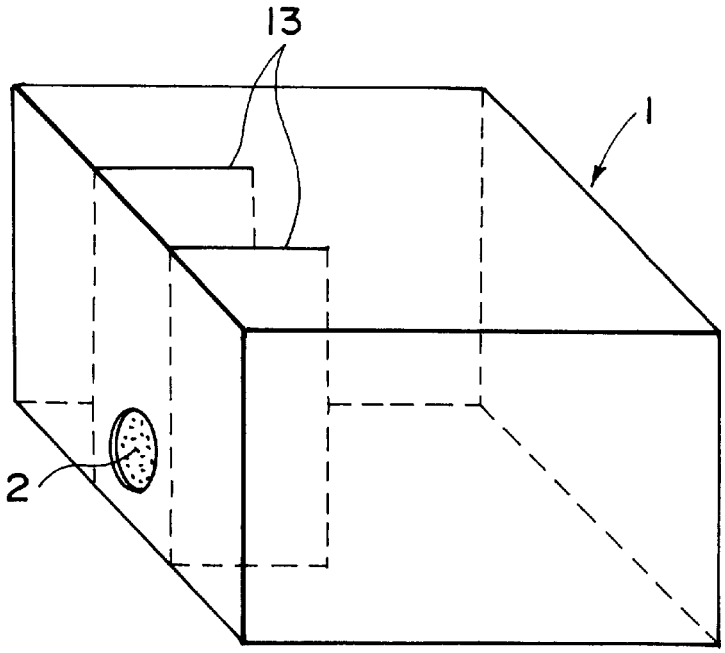
FIG. 9 is a perspective view of an ink cartridge according to a further embodiment of the present invention.

Referring to FIGS. 8 and 9, an embodiment for providing a solution to this problem will be described.

In FIG. 8, a wide ink cartridge 1 is shown, in which a portion having an opening 2 for supplying the ink to the recording head is projected as a projection 12. The vacuum producing material 3 is accommodated therein. The distance IW between the opposite walls in the projection 12 is determined so as to satisfy the above-described condition, and the vacuum producing material 3 is sandwiched thereby to provide the effects of the present invention.

FIG. 9 shows another wide ink cartridge 1, in which ribs 13 are formed on the internal wall of the vacuum producing material accommodating portion having the opening 2 for supplying the ink to the recording head. The vacuum producing material is sandwiched by the ribs to satisfy the above-described conditions.

The configuration, dimensions and the like of the projection 12 and ribs 13 are optimized in consideration of the configuration of the container, the ink and the sponge.

Referring to FIGS. 6 and 7, are further embodiment will be described in which the ink utilization factor is improved and in which a separate ink container is used.

Figure 6A:
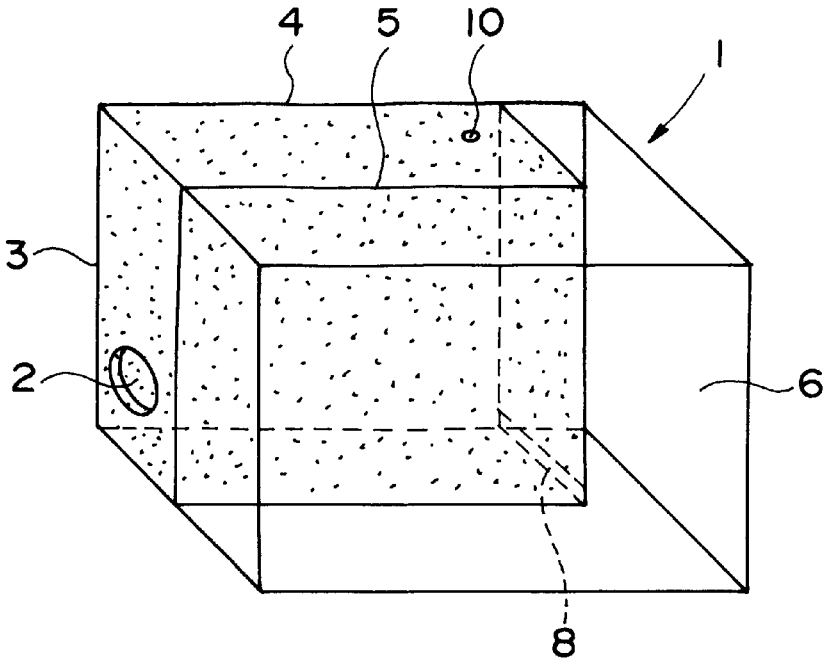
FIGS. 6A and 6B are perspective and sectional views of an ink cartridge according to another embodiment of the present invention.
Figure 6B:
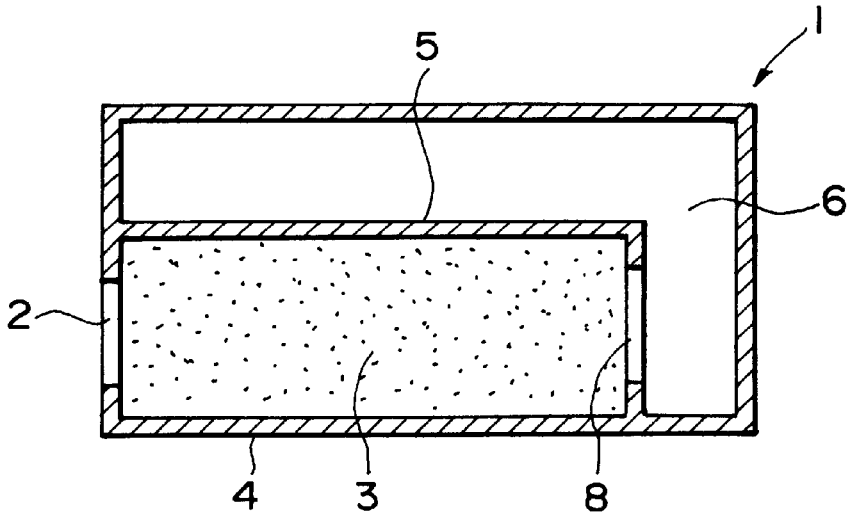

FIG. 6A is a perspective view of a wide ink cartridge according to this embodiment, and FIG. 6B is a sectional view of the bottom thereof.

In FIG. 6A, the ink container of the ink cartridge shown in FIG. 5 is formed into L-shape enclosing the vacuum producing material accommodating portion, so that a wide cartridge is provided.

Figure 7A:
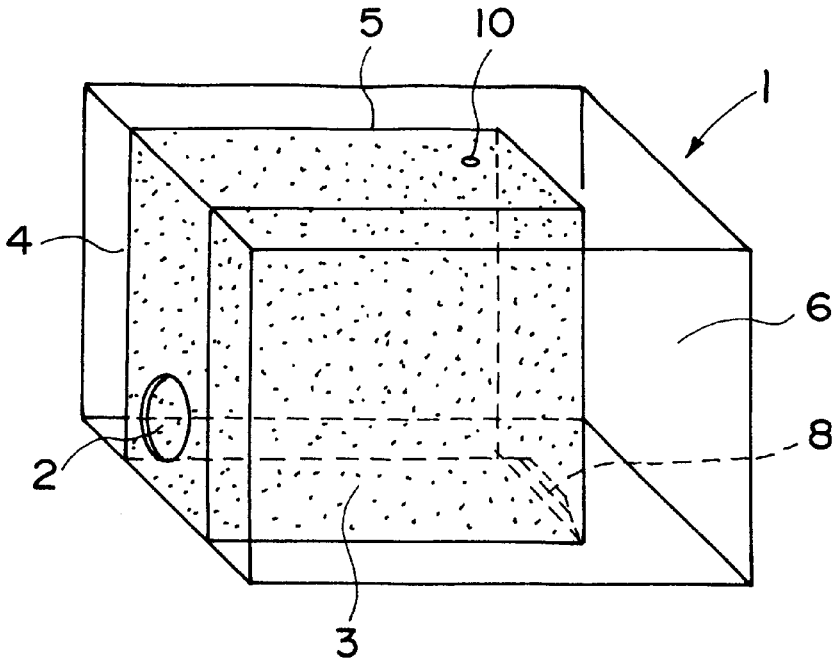
FIGS. 7A and 7B are a perspective view and a sectional view of an ink cartridge according to a further embodiment of the present invention.
Figure 7B:
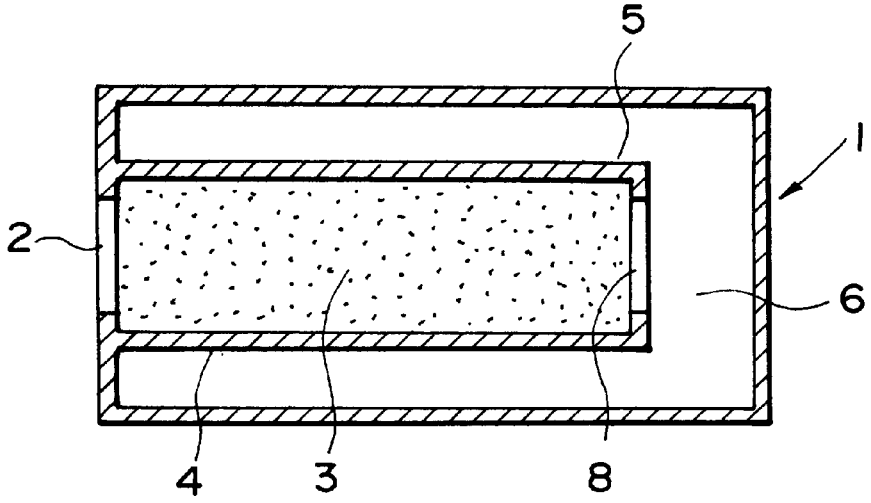

In FIG. 7A shows another wide ink cartridge, and FIG. 7B is a sectional view of the bottom thereof.

As shown in FIG. 7B, the ink container is in the form of a channel to enclose the vacuum producing material accommodating portion, so that a wide ink cartridge is constituted.

As shown in the Figure, the opening in the embodiment of FIG. 6A is shifted to one side, and in the embodiment of FIG. 7A, the opening is substantially at the center.

In these embodiments, the diameter N of the supply pipe, the distance IW between the sandwiching wall surfaces, and the distance of insertion L satisfy the conditions described hereinbefore.

As described in the foregoing, according to the present invention, the proper vacuum is maintained from the initial stage to the end stage of use irrespective of whether the recording operation is carried out or not. Therefore, the high speed recording is permitted, and the ink leakage under the ambient conditions of the ink jet recording apparatus, can be prevented.

Additionally, the handling of the ink cartridge during the exchange is easy, and the ink leakage or the ink stop does not occur by the mounting or demounting of the ink cartridge.

Furthermore, the ink cartridge is highly reliable during the transportation thereof. It is easy to manufacture at low cost with the high utilization factor in the exchangeable ink jet cartridge.

(Embodiment 3)

Figure 10:
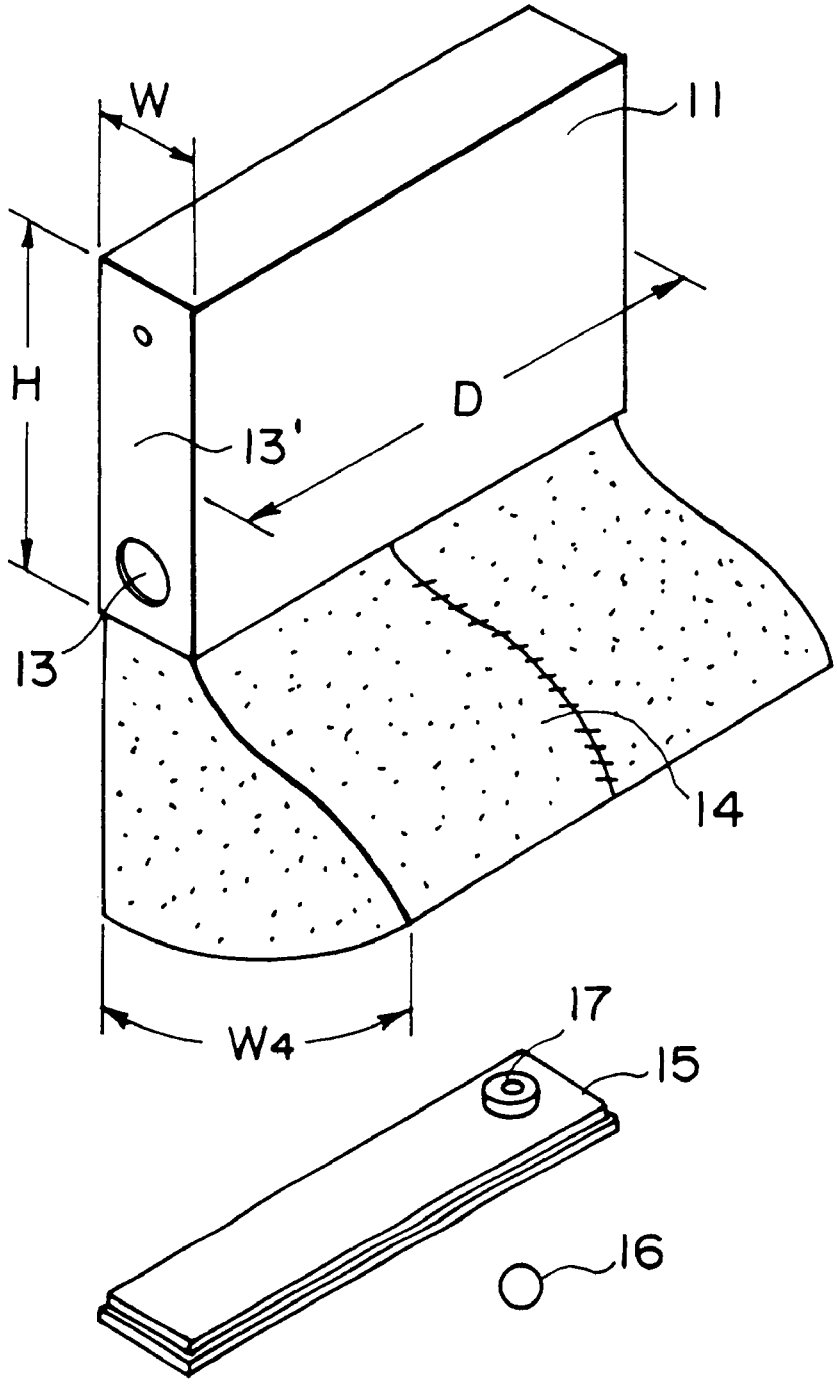
FIG. 10 is a perspective view of various parts of the ink cartridge.

In this embodiment, the height H of the container and the depth D of the container are determined on the basis of the width of the ink container determined in the manner described above. FIG. 10 illustrates the parts of the exchangeable ink cartridge according to this embodiment. The ink container 11 is generally rectangular parallelepiped having a width W on a surface 13' having the opening 13 for connection with the recording head (the width W is substantially equal to the distance IW between the sandwiching walls when the wall thickness is small), and a height H and a depth D. Inside the ink container 11, the absorbing material 14 is disposed with compression in the direction of the width W. A width W4 before compression is larger, that is, W<W4.

Designated by a reference numeral 15 is a cover of the container, and is hermetically fused on the container 11 by US fusing or the like after the absorbing material 14 is incorporated.

Then, the ink is injected into the container, and the injection port 17 is plugged with a plug 16 to prevent the ink leakage.

FIG. 11 is a sectional view when the absorbing material 14 is inserted into the container 11.

Figure 11A:
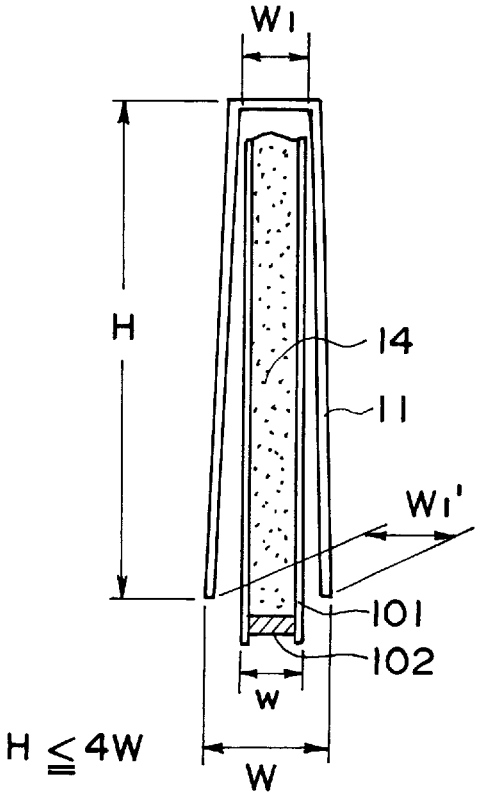
FIGS. 11A and 11B are sectional views illustrative insertion of the vacuum generating material.

FIG. 11A shows an insertion of an absorbing material in which H≦4W. By the absorbing material guide 101, the absorbing material 14 is compressed such that it is smaller than the minimum inter-wall distance W1, and the absorbing material guide dimension w satisfies w<W1.

Usually, the dimension W1 satisfies W1>W1' where W is an inlet dimension. This is because when the container 11 is molded by injection molding or the like, the ink dimension is required to remove from the metal mold. The required inclination increases with the increase of the height H.

Figure 11B:
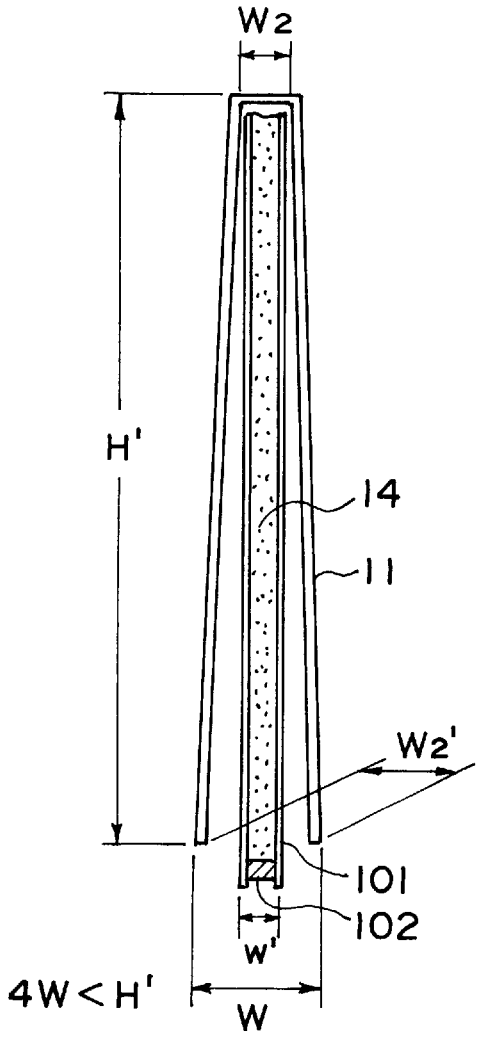

FIG. 11B shows a case in which the height H' satisfies 4W<H'. When the ink container 11 is formed with the same inclination as in FIG. 11A in this case, the minimum inter-wall dimension W2 is smaller than W1, and the necessity arises to further reduce a width w' of the absorbing material guide 101.

Reduction of w' means increase of the compression ratio when the absorbing material 14 is inserted, and the force provided by the absorbing material 14 to push the absorbing material guide 101 back also increases. With the increase of this force, the friction when the absorbing material is removed from the absorbing material guide by a pusher 102 is increased.

As a result of experiments, even if the absorbing material guide is made of low friction coefficient material such as Teflon or the like, the insertion of the absorbing material is not enough with the result of crease of the absorbing material or folding or the like, which causes non-uniform compression, unless the height H when the compression of the absorbing material 14 is 1–6 times is not more than 4W.

Even if the ink container is assembled at the cost of the productivity and the yield or the like, the inter-wall dimension of the container is significantly different between W1' and W2', and therefore, the compression after the insertion of the absorbing material is significantly different. Then, the capillary force produced by the compression of the absorbing material is significantly different, so that the stable ink supply is not expected.

FIG. 11 does not show an example of H<W. In this case, the area in which the absorbing material is contacted to the wall surface is small, with the result that when the absorbing material guide 101 is pulled out, the absorbing material may be also removed from the container. Therefore, the productivity is not good, and the cost is increased.

As for a means for avoiding the influence of the inclination, the absorbing material may be configurated beforehand as a trapezoid in consideration of the inclination. However, if this is done, the manufacturing becomes cumbersome because of the absorbing material is given an orientation, and the material is wasted to provide the trapezoidal configuration.

The force of pushing the absorbing material guide back, is different at different positions, and the pushing force by the pusher 102 as to be determined in consideration of the fact. In addition, the compression distribution is not always improved by using the trapezoidal configuration.

Figure 12A:
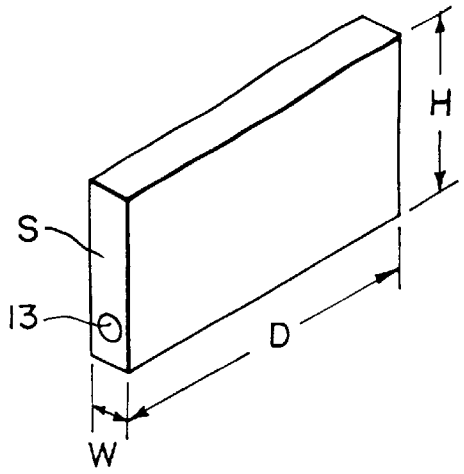
FIGS. 12A, 12B and 12C illustrate ink supply.
Figure 12B:
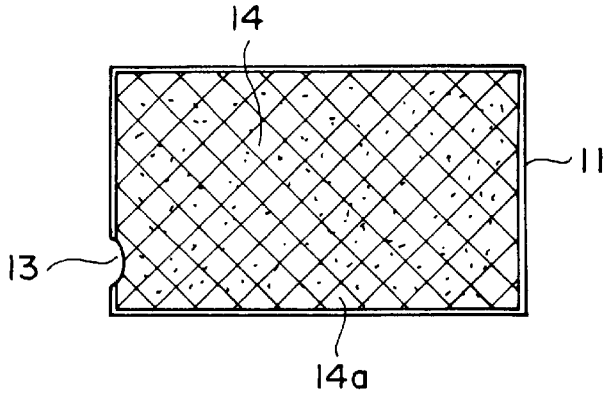

FIG. 12 shows the ink supply in the case that the depth D satisfies 3W≦D≦10W. In FIG. 12B, the container is full of the ink, wherein the absorbing material 14 is indicated by dot area, and he hatched portion is filled with the ink.

Figure 12C:
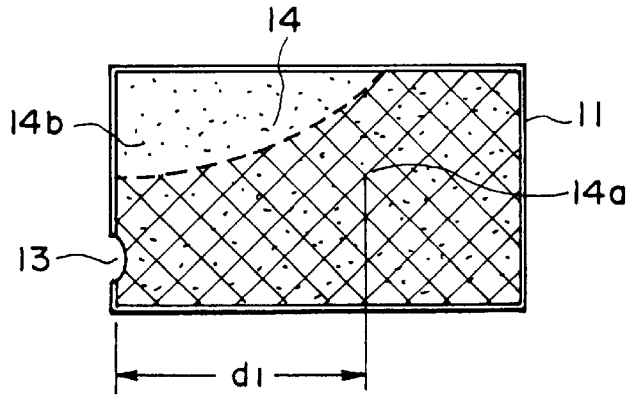

By the recording operation, the ink is supplied from the absorbing material 14 toward the recording head. Sooner or later, as shown in FIG. 12C, there appear non-ink portion 14*b* and ink portion 14*a*. With the continuance of the ink supply, the non-ink portion 14*b* occupies the entirety of the ink container. In the state shown in FIG. 12C, the ink is supplied from the connecting portion 13 to the recording head side through a distance $d_1$.

Figure 14:
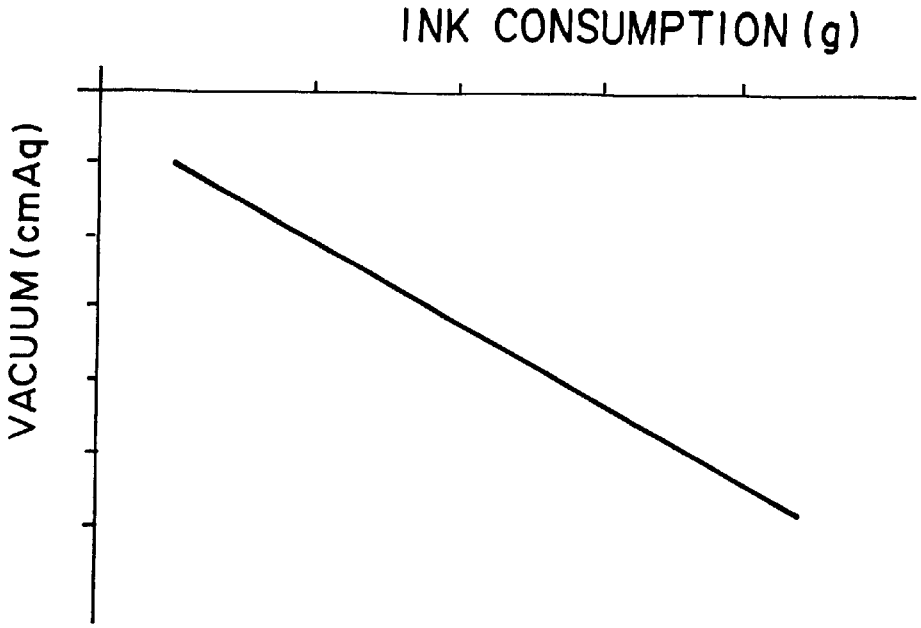
FIG. 14 illustrates a condition for permitting ink movement in the vacuum producing material.

The no-ink portion 14*b* has a larger ink absorbing tendency, and the vacuum in the ink cartridge increases with consumption of the ink as shown in FIG. 14.

FIG. 13 schematically shows the case in which 10W<D, that is, the case different from the embodiment.

Figure 13A:
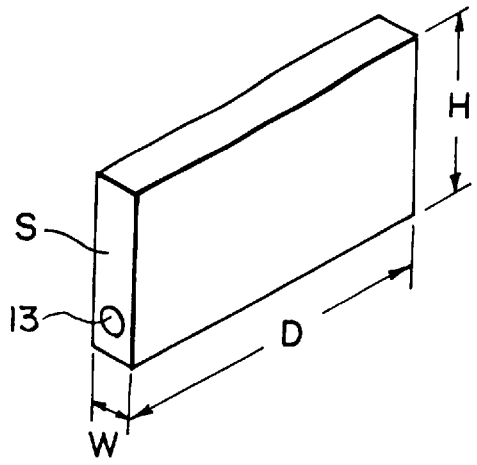
FIGS. 13A, 13B, and 13C illustrate ink supply in comparison.
Figure 13B:
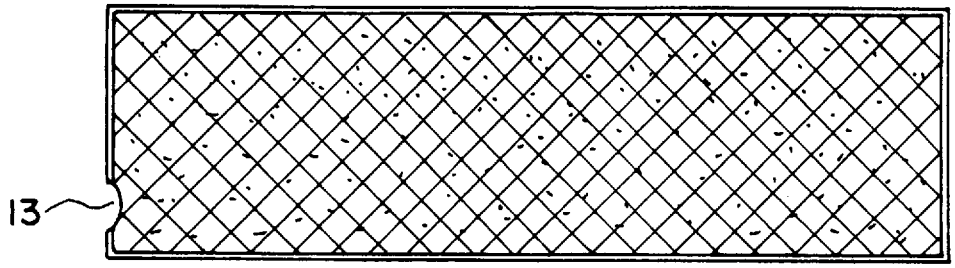
Figure 13C:
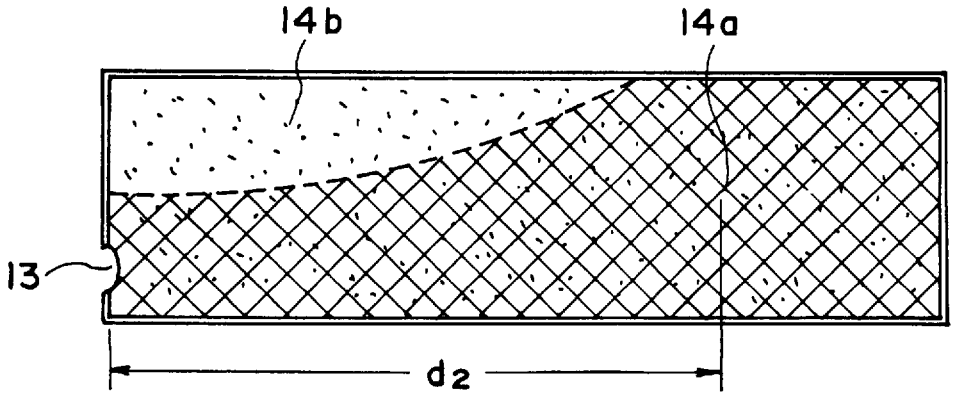

Similarly to the foregoing, with the consumption of the ink, the state of FIG. 13B changes to that of FIG. 13C. With the state of FIG. 13C, the ink moves the distance $d_2$ toward the recording head.

When the distance D (that is, the depth D of the container) is increased, increased resistance against the ink flow through the ink absorbing material is a problem when the ink is to be used to the end. When the comparison is made between FIG. 12A and FIG. 13A, the cross-sectional areas S are the same if the W and H are the same, and the flow resistance is Kαd/S, where K is a coefficient, d is a moving distance and a is an ink viscosity.

In FIGS. 12A and 13A, $d_1<d_2$, and therefore, the flow resistance is larger in FIG. 13A. For this reason, with the consumption of the ink, the force impeding the ink supply is added by the flow resistance in addition to the vacuum produced by the consumption of the ink in the ink absorbing material 14. With the increase of the depth D, the volume of the absorbing material is increased, and therefore, the no-ink area is increased so that the produced vacuum is high. Therefore, the stable ink supply is deteriorated.

As a result of experiments, the printing qualities are not influenced by satisfying D≦10W, where W is a variable constituting a cross-section effective for the ink supply from the absorbing material.

With the increase of the depth D of the container, it is difficult to inject the ink with proper ink distribution.

Figure 15:
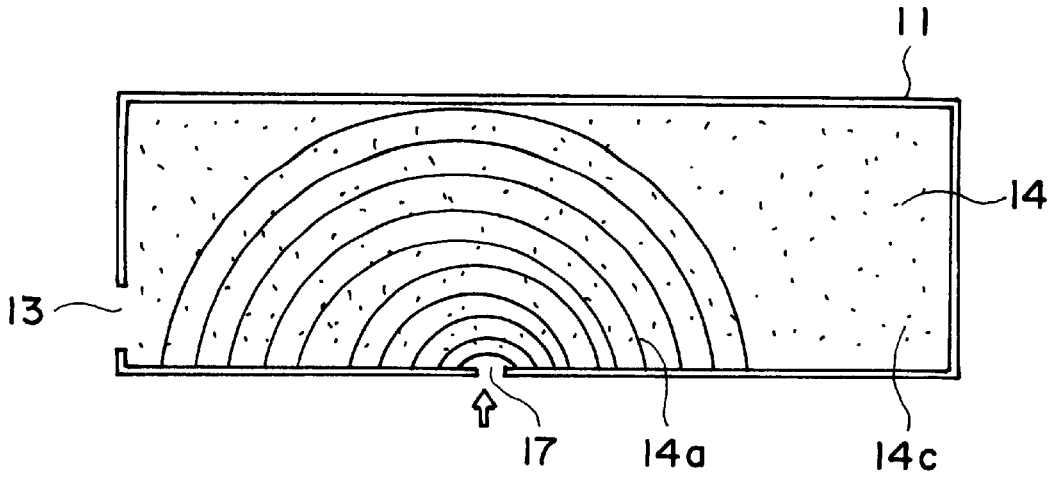
FIG. 15 illustrates ink injection, as compared with the present invention.

More particularly, as shown in FIG. 15, the no-ink region 14*c* appears. Then, the usable ink quantity is not increased despite the size increase.

Figure 16:
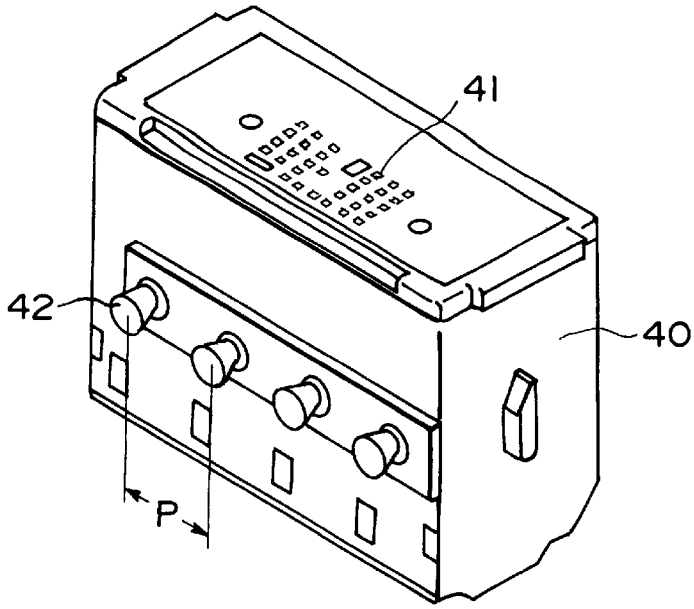
FIG. 16 is a perspective view of a plurality of heads incorporating an embodiment of the present invention.
Figure 17:
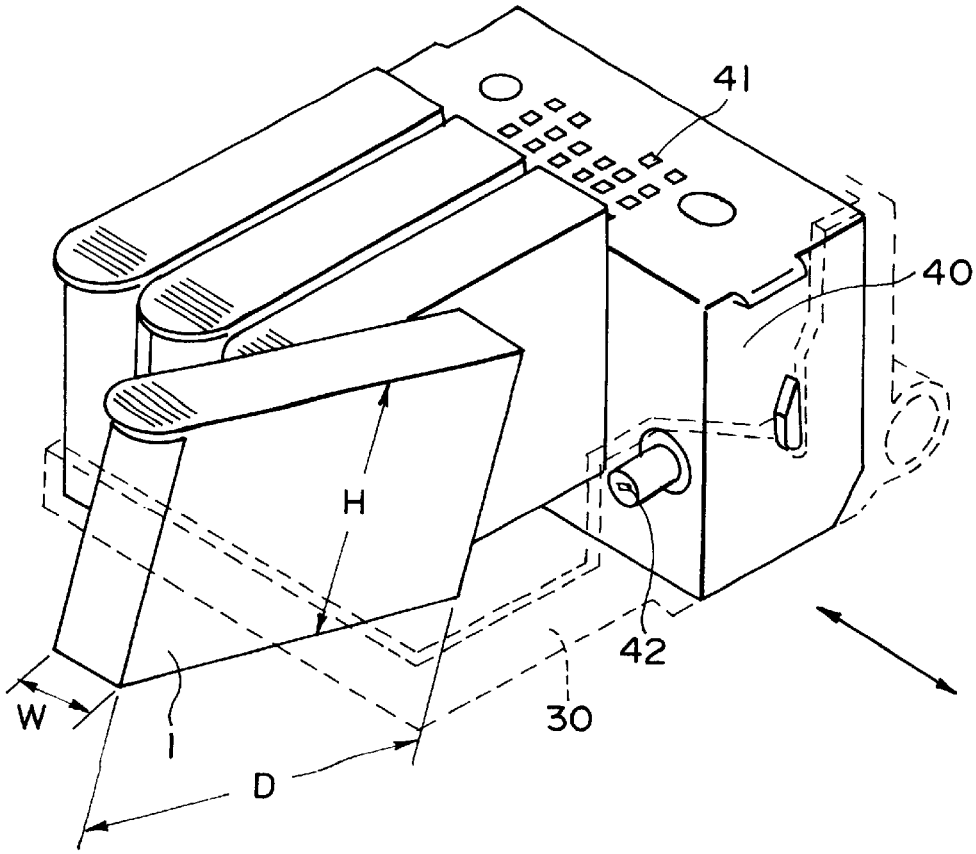
FIG. 17 illustrates an ink container mounted to the recording head on the carriage.

FIGS. 16 and 17 are perspective view of a recording head unit and a carriage with which the ink cartridge of this embodiment is usable.

In FIG. 16, the recording heads are juxtaposed with a distance P, so that the ink receiving ports 42 are disposed at regular intervals P. Designated by reference numerals 41 are contact pads for receiving recording electric signals from a main assembly (not shown) of a recording apparatus.

As show in FIG. 17, the exchangeable cartridge of this embodiment is coupled with a recording head 40 on a carriage 30, which moves in a scanning direction, while the ink is being supplied. As will be understood from the above, the ink container width W satisfies W≦P.

Figure 18:
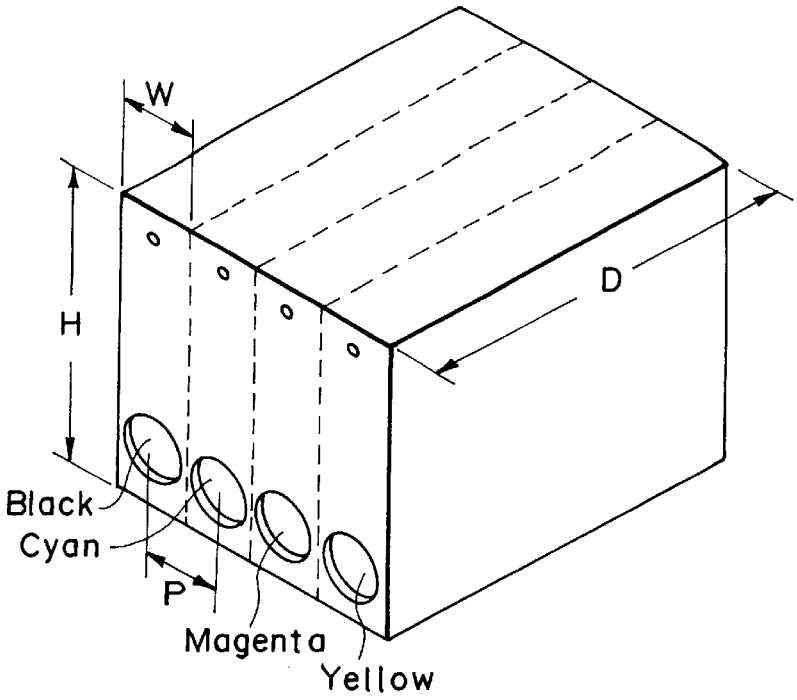
FIG. 18 is a perspective view of an ink cartridge according to a further embodiment of the present invention.
Figure 19:
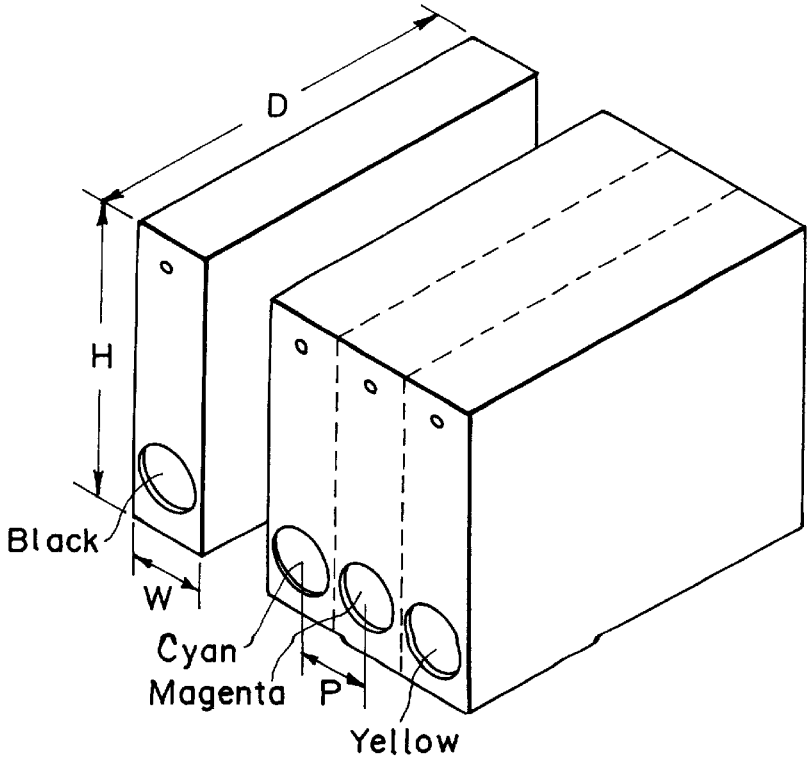
FIG. 19 is a perspective view of an ink cartridge according to a further embodiment of the present invention.

FIGS. 18 and 19 show a further embodiment, in which ink cartridges for different colors are unified. In this case, the configuration of an ink cartridge for one color satisfies the above-described conditions.

As described in the foregoing, the exchangeable ink cartridge of this invention satisfies $W \leqq H \leqq 4W$, and $W \leqq D \leqq 10W$ where W is a width of a side having an opening for receiving the ink supply tube of the recording head, H is a height, and D is a depth of the ink cartridge. The configuration of the cartridge is generally rectangular parallelepiped.

These conditions may be incorporated into the container having been described in conjunction with FIGS. 6A, 7A, 8A and 9A.

When a plurality of exchangeable ink cartridges are unified, the following is satisfied:

$$W \leqq P \leqq H$$

where P is a pitch of the recording heads (that is, a distance between corresponding elements of adjacent recording heads) in the scanning direction. By doing so, the vacuum producing material absorbs and retains properly the ink, so that the ink moves through the vacuum producing material in accordance with consumption of the ink by the recording operation until the entire quantity of the ink is used up. In addition, the configuration is small.

Thus, exchangeable color ink cartridge can be provided with low cost, with high reliability and high utilization factor.

While the invention has been described with reference to the structures disclosed herein, it is not confined to the details set forth and this application is intended to cover such modifications or changes as may come within the purposes of the improvements or the scope of the following claims.

What is claimed is:

1. A liquid supply system for a liquid jet head having a liquid supply tube and a liquid cartridge detachably mountable to a liquid jet head, said liquid supply system comprising:

a liquid cartridge body having an end wall and two facing side walls connected to the end wall;

a liquid absorbing material in said body;

a liquid supply port provided in a portion of the end wall for receiving the liquid supply tube while permitting said liquid absorbing material to be deformed by a distance by insertion of said liquid supply tube into said liquid supply port; and an air vent for fluid communication between an inside of said body and ambience, wherein said liquid absorbing material is sandwiched by the side walls of said cartridge body, the side walls at least at a location adjacent to the portion of the end wall having said liquid supply port are spaced apart by an interior distance not more than 12 mm, said liquid supply port has a width in a direction parallel to the end wall greater than one-half of said interior distance, said liquid supply tube is insertable into said liquid supply port, said liquid absorbing material is deformed by insertion of said liquid supply tube into said liquid supply port, the distance of deformation of said liquid absorbing material in a direction of said insertion is smaller than said interior distance, said insertion of said liquid supply tube causes compression of said liquid absorbing material, and said compression provides a space capable of retaining a liquid.

2. A system according to claim 1, further comprising a liquid reservoir chamber containing the liquid to be supplied to said cartridge body, wherein said liquid reservoir chamber is in fluid communication with said liquid cartridge body through a communication port.

3. A system according to claim 2, wherein said liquid reservoir chamber is disposed behind said liquid cartridge body.

4. A system according to claim 2, wherein said liquid reservoir chamber has a shape substantially that of a channel, and said liquid cartridge body is located in the channel.

5. A system according to claim 2, wherein said liquid reservoir chamber is extended in a generally L-shape at lateral and rear sides thereof.

* * * * *